US007179151B1

(12) United States Patent
Bottema et al.

(10) Patent No.: US 7,179,151 B1
(45) Date of Patent: Feb. 20, 2007

(54) POLISHING PAD, A POLISHING APPARATUS, AND A PROCESS FOR USING THE POLISHING PAD

(75) Inventors: Brian E. Bottema, Austin, TX (US); Stephen F. Abraham, Austin, TX (US); Alex P. Pamatat, Grenoble (FR)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 11/390,292

(22) Filed: Mar. 27, 2006

(51) Int. Cl.
*B24B 1/00* (2006.01)

(52) U.S. Cl. ..... 451/6; 451/41; 451/8; 451/285

(58) Field of Classification Search ..... 451/5, 451/6, 41, 60, 8–11, 285–290, 526, 921; 438/7–10, 692, 705
See application file for complete search history.

(56) References Cited

U.S. PATENT DOCUMENTS 5,433,651 A * 7/1995 Lustig et al. ..... 451/6
5,461,007 A 10/1995 Kobayashi
5,691,253 A 11/1997 Kobayashi
6,146,248 A * 11/2000 Jairath et al. ..... 451/41
6,254,459 B1 * 7/2001 Bajaj et al. ..... 451/41
6,280,289 B1 * 8/2001 Wiswesser et al. ..... 451/6
6,280,290 B1 * 8/2001 Birang et al. ..... 451/6
6,323,046 B1 * 11/2001 Agarwal ..... 438/8
6,454,630 B1 * 9/2002 Tolles ..... 451/6
6,599,765 B1 7/2003 Boyd et al.

OTHER PUBLICATIONS

U.S. Appl. No. 11/221,376, filed Sep. 6, 2005, entitled "Platen Endpoint Window with Pressure Relief," by Bottema.

* cited by examiner

*Primary Examiner*—Lee D. Wilson
*Assistant Examiner*—Anthony Ojini

(57) ABSTRACT

A polishing pad can include a first layer and a second layer. The first layer can have a first polishing surface and a first opening. The second layer can have an attaching surface and a second opening substantially contiguous with the first opening. The polishing pad can further include a pad window lying within the first opening. The pad window can include a second polishing surface and a gas-permeable material. In one aspect, an apparatus can include an attaching surface of a platen lying adjacent to the attaching surface of the polishing pad. In another aspect, a process for polishing can include changing a temperature of a gas within a spaced-apart region formed between a pad and a platen. The process can also include forming a gas flux across the polishing pad after polishing has started.

20 Claims, 2 Drawing Sheets

-PRIOR ART-

40

50

60

POLISHING PAD, A POLISHING APPARATUS, AND A PROCESS FOR USING THE POLISHING PAD

RELATED APPLICATION

The present disclosure relates to U.S. patent application Ser. No. 11/390,176, entitled "Polishing Pad, a Polishing Apparatus, and a Process For Using the Polishing Pad" by Bottema et al. filed on Mar. 27, 2006, which is assigned to the current assignee hereof and incorporated by reference in its entirety.

BACKGROUND

1. Field of the Disclosure

The present disclosure relates to polishing pads, polishing apparatuses, and processes for using polishing pads, and, more particularly, to polishing pads that have pad windows, polishing apparatuses that include such polishing pads, and processes for using them.

2. Description of the Related Art

A pad window within a polishing pad can serve as a portion of a path for laser light for measuring a workpiece during a polishing process. The pad window can cause problems due to its configuration within a chemical mechanical polishing apparatus. FIG. 1 includes an illustration of a cross-sectional view of a chemical mechanical polishing ("CMP") apparatus 10 and a workpiece 128. The CMP apparatus 10 can include a platen 12 and a conventional polishing pad 14. The platen 12 can include a platen window 16. The CMP apparatus 10 also includes a laser 18 and a detector 110 that can be used for end-point detection. The conventional polishing pad 14 includes a first layer 112 that has an opening 114 and a substantially planar polishing surface 116. A pad window 122 lies within the opening 114 in the first layer 112. The pad window 122 has a polishing surface 126. The conventional polishing pad 14 can have a second layer 118, lying between the first layer 112 and the platen 12. Since the second layer 118 is substantially opaque to a radiation beam from the laser 18, an opening 120 in the second layer is formed such that there is a path for the radiation beam to pass from the laser 18 to the workpiece surface and back to the detector 110.

The path is intermittently formed such that a measurement, using the laser 18 and the detector 110, can be taken when the pad window 122 lies between the platen 12 and the workpiece 128. However, changes in temperature during polishing can distort the polishing surface 126 of the pad window 122. Distortion can cause problems with a polishing process. Examples of such problems can be a false or absent reading of endpoint detection, part or all of the pad window 122 becoming separated from the rest of the conventional polishing pad 14, excessive wear or a breach of the pad window 122, or any combination thereof. Other problems caused by the distortion can include damage to the workpiece 128 or the CMP apparatus.

BRIEF DESCRIPTION OF THE DRAWINGS

The present disclosure may be better understood, and its numerous features and advantages made apparent to those skilled in the art by referencing the accompanying drawings. The subject of the disclosure is illustrated by way of example and not limitation in the accompanying figures.

Figure 1:
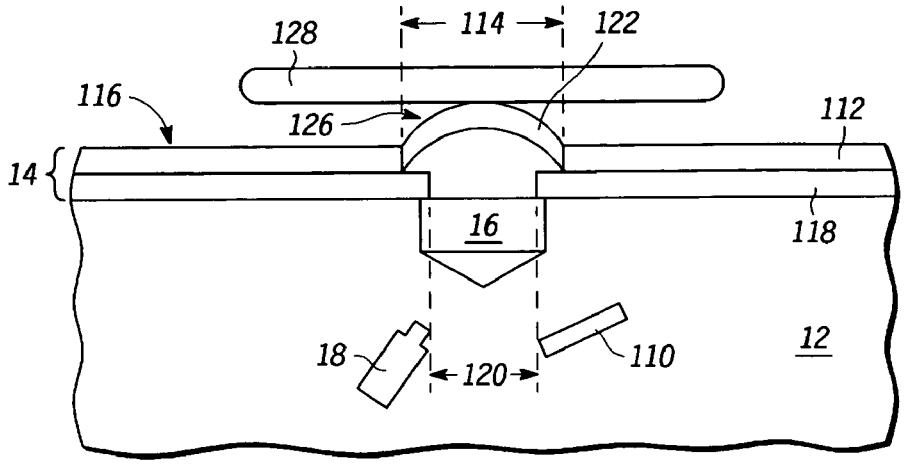
FIG. 1 includes a cross-sectional view of an illustration of a wafer and a portion of a CMP apparatus including a polishing pad (prior art).

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention. The use of the same reference symbols in different drawings indicates similar or identical items.

DETAILED DESCRIPTION

A polishing pad can include a pad window. In a first aspect, a polishing pad can include a first layer. The first layer can include a first polishing surface and a first opposing surface opposite the first polishing surface. The first layer can also include a first opening extending through the first layer. The polishing pad can also include a second layer. The second layer can include an attaching surface, a second opposing surface opposite the attaching surface. The second opposing surface can lie closer to the first opposing surface of the first layer than to the first polishing surface of the first layer. The second layer can also include a second opening extending through the second layer, and the second opening can be substantially contiguous with the first opening of the first layer. The polishing pad can also include the pad window lying within the first opening. The pad window can include a second polishing surface substantially contiguous with the first polishing surface, and a third opposing surface opposite the second polishing surface. The third opposing surface can lie in a region between the first polishing surface of the first layer and the attaching surface of the second layer. The pad window can include a gas-permeable material.

In a second aspect, a polishing apparatus can include a platen. The platen can include a first attaching surface. The polishing apparatus can also include a polishing pad. The polishing pad can include a first layer overlying and spaced-apart from the platen. The first layer can include a first polishing surface and a first opposing surface opposite the first polishing surface. The first layer can also include a first opening extending through the first layer. The polishing pad can also include a second layer lying between the first layer and the platen. The second layer can include a second attaching surface lying adjacent to the first attaching surface of the platen. The second layer can also include a second opposing surface opposite the second attaching surface, and lying closer to the first opposing surface of the first layer than to the first polishing surface of the first layer. The second layer can further include a second opening extending through the second layer, the second opening substantially contiguous with the first opening of the first layer. The polishing pad can further include a pad window lying within the first opening of the first layer. The pad window can include a second polishing surface substantially contiguous with the first polishing surface of the first layer. The pad window can also include a third opposing surface opposite the second polishing surface. The pad window can include a gas-permeable material.

In a third aspect, a process of polishing can include forming a spaced-apart region between a polishing pad and a platen. The spaced-apart region can include a gas, and the gas can have a first averaged temperature. The process can also include polishing a workpiece, wherein at a point in time during polishing, the spaced-apart region lies between the platen and the workpiece. The process can further include changing a temperature of the gas within the spaced-apart region from the first averaged temperature to a second averaged temperature after polishing the workpiece has started. The process can still further include forming a gas flux across the polishing pad after polishing the workpiece has started. Specific embodiments of the present disclosure will be better understood with reference to the description below and the accompanying figures.

Some terms are defined or clarified as to their intended meaning as they are used within this specification. The term "averaged," when referring to a value, is intended to mean an intermediate value between a high value and a low value. For example, an averaged value can be an average, a geometric mean, or a median.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term "composition" is intended to refer to the chemical make up of a substance. A composition can be an element, compound, mixture, solution, alloy, or any combination thereof. For example, the composition of a fabric can be a mixture of wool and cotton fibers.

The term "contiguous" is intended to mean that two or more articles or other objects lie or are otherwise positioned such that nothing of significance lies between the two or more articles or other objects. For example, one of the articles or other objects can touch another one of the articles or other objects.

The term "dry" is intended to indicate an absence of the liquid form of a composition. For example a dry region can have water vapor or ice present, but not liquid water.

The term "elevation" is intended to indicate a closest distance between a layer or other object and a reference plane.

As used herein "material" is intended to refer to the physical structure of substance. A material can have a structure with pores or gaps in it. For example, a fabric is a material made from fibers and has pores (e.g. gaps between the fibers). These pores are considered distinct from a hole, which is an interruption of the structure. A buttonhole is an example of a hole in a fabric.

The term "workpiece" is intended to mean a substrate and, if any, one or more layers one or more structures, or any combination thereof attached to the substrate, at any particular point of a process sequence. Note that the substrate may not significantly change during a process sequence, whereas the workpiece significantly changes during the process sequence. For example, at the beginning of a process sequence, the substrate and workpiece are the same. After a layer is formed over the substrate, the substrate has not changed, but now the workpiece includes the combination of the substrate and the layer.

Additionally, for clarity purposes and to give a general sense of the scope of the embodiments described herein, the use of the "a" or "an" are employed to describe one or more articles to which "a" or "an" refers. Therefore, the description should be read to include one or at least one whenever "a" or "an" is used, and the singular also includes the plural unless it is clear that the contrary is meant otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety. In case of conflict, the present specification, including definitions, will control. In addition, the materials, methods, and examples are illustrative only and not intended to be limiting.

To the extent not described herein, many details regarding specific materials, processing acts, and circuits are conventional and may be found in textbooks and other sources within the semiconductor and microelectronic arts. Other features and advantages of the invention will be apparent from the following detailed description, and from the claims.

Figure 2:
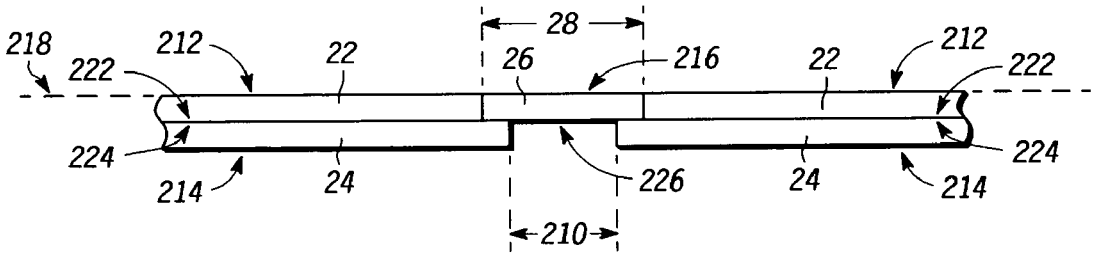
FIG. 2 includes an illustration of a cross-sectional view of an embodiment of a polishing pad.

FIG. 2 includes an illustration of a cross-sectional view of a polishing pad 20 including a layer 22, a layer 24, and a pad window 26. The layer 22 can include a polishing surface 212 that is designed to be substantially planar when the polishing pad 20 would be attached to a platen. The polishing surface 212 can have a texture or be substantially smooth. For example, in one embodiment, the polishing surface 212 can be grooved or perforated. The layer 22 can also have an opposing surface 222 opposite the polishing surface 212. The layer 22 can include a material that is solid, open cell, closed cell, woven, felted, or any combination thereof. The layer 22 can have a composition that includes a rubber compound, a urethane compound, an adhesive compound, an abrasive compound, or any combination thereof. The layer 22 can include an opening 28. The layer 22 can have a thickness in a range of approximately 0.05 mm to approximately 12.7 mm (approximately 2 to approximately 500 mils). In one embodiment, the opening 28 can extend through an entire thickness of the layer 22.

The layer 24 can include an attaching surface 214 that is designed to allow the polishing pad 20 to be attached to a corresponding attaching surface of a platen. The layer 24 can also have an opposing surface 224 opposite the attaching surface 214. The layer 24 can have a thickness in a range of approximately 0.05 mm to approximately 12.7 mm (approximately 2 to approximately 500 mils). In one embodiment, the opposing surface 224 can be adjacent to the opposing surface 222 of the layer 22. In another embodiment, the layer 22 can lie immediately adjacent to the layer 24. The layer 24 can include a material or composition as described for the layer 22. The layer 24 can have a same or a different material or composition as the layer 22. The layer 24 can include an opening 210. In one embodiment, the opening 210 can extend through an entire thickness of the layer 24 and be contiguous with the opening 28. The opening 28 can have a perimeter of a same or a different length than a perimeter of the opening 210. The opening 28 can lie adjacent to the opening 210 such that each of the opening 28 and the opening 210 can comprise a portion of a contiguous region.

The pad window 26 can lie within the opening 28, and include a polishing surface 216 and an opposing surface 226. The polishing surface 216 can be substantially contiguous with the polishing surface 212. The polishing surface 216 and the polishing surface 212 can lie along a polishing plane 218. The opposing surface 226 can be designed to spaced-apart from an exterior surface of a platen window when the polishing pad would be attached to a platen. Thus, the pad window 26 can substantially fill a portion of the opening 28 and may or may not partially fill a portion of the opening 210. The pad window 26 can include a material, composition, or any combination thereof that can be gas-permeable. In an embodiment, the pad window 26 can have a composition capable of allowing transmission of a predetermined wavelength or spectrum of radiation. In one embodiment, the pad window 26 can include a urethane material, a polyethylene, a polytetrafluoroethylene ("PTFE"), a polypropylene, or any combination thereof. In a particular embodiment, the pad window 26 can lie immediately adjacent to the layer 22 along the perimeter of the opening 28.

The layer 22 and the layer 24 of the polishing pad 20 can be formed separately and subsequently can be attached together by a conventional or proprietary technique. In one embodiment, the opening 28 in the layer 22 and the opening 210 in the layer 24 can be formed prior to attaching the layer 22 and the layer 24 together. In another embodiment, the layer 22 and the layer 24 can be joined together before the opening 28 and the opening 210 are formed. The pad window 26 can be bonded, glued, set, molded in place or otherwise attached using a conventional or proprietary technique within a region including both of the opening 28 and the opening 210.

Figure 3:
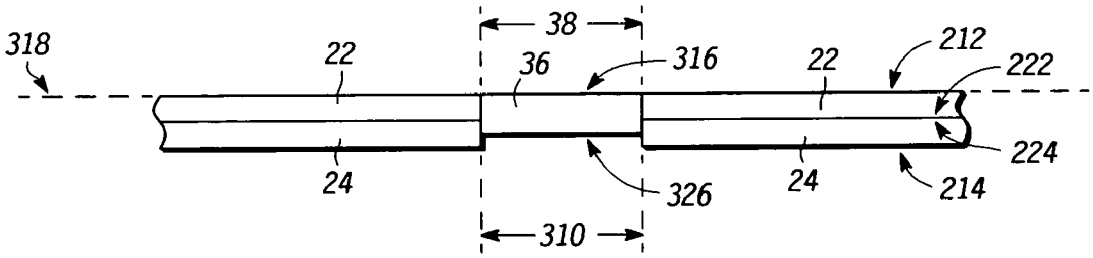
FIG. 3 includes an illustration of a cross-sectional view of an alternative embodiment of a polishing pad.

In another embodiment, a pad window may be formed with a different shape, thickness or any combination thereof, such that an opposing surface of the pad window can lie at different elevations relative to a polishing surface. FIG. 3 includes an illustration of a polishing pad 30 including the layer 22, the layer 24, and a pad window 36, wherein the pad window 36 has a different shape than has been described in previous embodiments. The layer 22 can include the opening 38, the polishing surface 212, and the opposing surface 222. The layer 24 can include an opening 310, the attaching surface 214, and the opposing surface 224. The pad window 36 can include a material, composition, or any combination thereof as previously described for the pad window 26. In the illustrated embodiment, the pad window 36 can include a polishing surface 316 and an opposing surface 326. The polishing surface 212 and the polishing surface 316 can lie along a polishing plane 318. An elevation from the opposing surface 326 of the pad window 26 to the polishing plane 318 can be less than an elevation from the attaching surface 214 to the polishing plane 318. In a more particular embodiment, the pad window 36 can lie adjacent to the layer 24 along the perimeter of the opening 210.

Figure 4:
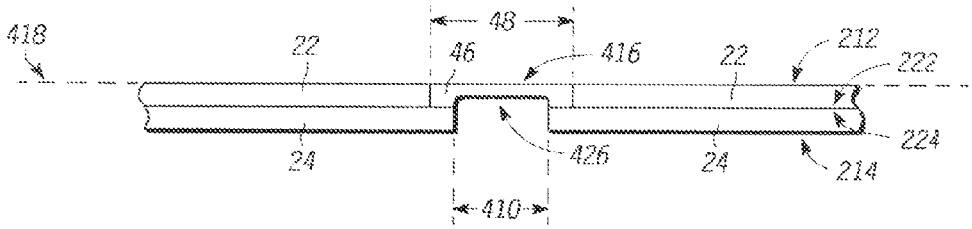
FIG. 4 includes an illustration of a cross-sectional view of another alternative embodiment of a polishing pad.

FIG. 4 includes an illustration of a polishing pad 40 including the layer 22, the layer 24, and a pad window 46, wherein the pad window 46 has another different shape than has been described in previous embodiments. The layer 22 can include an opening 48, the polishing surface 212, and the opposing surface 222. The layer 24 can include an opening 410, the attaching surface 214, and the opposing surface 224. The pad window 46 can include a material, composition, or any combination thereof as previously described for the pad window 26. The pad window 46 can have a polishing surface 416 and an opposing surface 426. The polishing surface 212 and the polishing surface 416 can lie along a polishing plane 418. In a particular embodiment, the elevation from the opposing surface 426 of the pad window 46 to the polishing plane 418 can be less than an elevation from the opposing surface 222 to the polishing plane 418.

Figure 5:
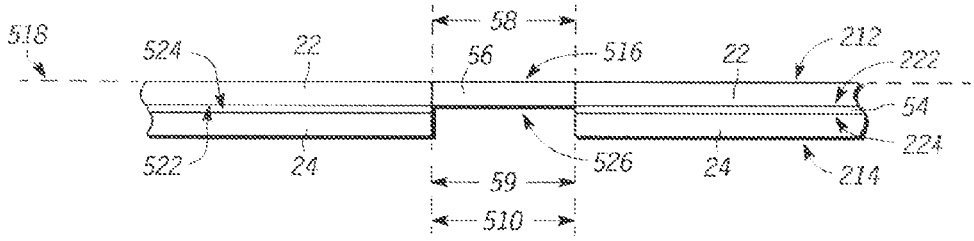
FIG. 5 includes an illustration of a cross-sectional view of yet another alternative embodiment of a polishing pad.

In yet another embodiment, an intervening layer can lie between the layer that includes the polishing surface and the layer that includes the attaching surface. FIG. 5 includes an illustration of a polishing pad 50 including the layer 22, the layer 24, a pad window 56, and a layer 54, wherein the layer 54 lies between the layer 22 and the layer 24. The layer 22 can include an opening 58, the polishing surface 212, and the opposing surface 222. The layer 24 can include an opening 510, the attaching surface 214, and the opposing surface 224. The layer 54 can include a first surface 522 and a second surface 524 and include an opening 59 extending through the layer 54. The first surface 522 can be the closest surface of the layer 54 to the layer 22, and the second surface 524 can be the closest surface of the layer 54 to the layer 24. The layer 54 can have a thickness in a range previously described for the layer 22.

The pad window 56 can have a polishing surface 516, an opposing surface 526, and substantially fill a portion of the opening 58. The polishing surface 212 and the polishing surface 516 can lie along a polishing plane 518. The pad window 56 can include a material, composition, or any combination thereof as previously described for the pad window 26. In one embodiment, the pad window 56 may or may not substantially fill a portion of the opening 58, lie adjacent to the layer 54 along a perimeter of the opening 58, or any combination thereof. In a further embodiment, the pad window 56 may or may not substantially fill a portion of the opening 510, lie adjacent to the layer 24 along a perimeter of the opening 510, or any combination thereof. In another embodiment, an elevation between the opposing surface 526 of the pad window 56 and the polishing plane 518 can be smaller than an elevation between the opposing surface 222 and the polishing plane 518. In still another embodiment, the elevation between the opposing surface 526 and the polishing plane 518 can be smaller than an elevation between the attaching surface 214 and the polishing plane 518.

Many other alternative embodiments of a polishing pad are possible that would form a spaced-apart region between a gas-permeable portion of a polishing pad and a platen when the polishing pad would be attached to a polishing apparatus. By varying the number of layers, the relative size and shape of openings through the layers, the relative thickness of a pad window portion, the materials of the layers and the pad window portion, or any combination thereof an almost limitless number of such pads can be made. In a particular embodiment, the gas-permeable portion of the layer including the polishing surface lies adjacent to an opening in the layer that includes the attaching surface. For example, in the case of polishing pad 20, the layer 22 could be continuous and not include the opening 28. A portion of the layer 22 lying adjacent to and extending across the opening 210 can be gas-permeable. Such a pad would not require a pad window portion between the spaced-apart region and the polishing surface.

Figure 6:
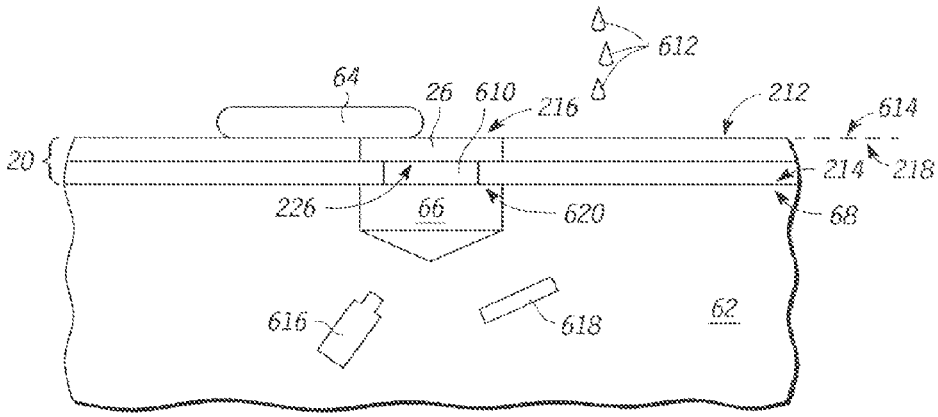
FIG. 6 includes an illustration of a cross-sectional view of a workpiece and a portion of a polishing apparatus including a polishing pad, during polishing, in accordance with an embodiment.

FIG. 6 includes an illustration of a cross-sectional view of a workpiece 64 and a portion of a polishing apparatus 60, including the polishing pad 20 and a platen 62, during polishing. Although the illustrated embodiment is described with respect to the polishing pad 20, another polishing pad (e.g., the polishing pad 30, the polishing pad 40, or the polishing pad 50) may be used in place of the polishing pad 20 in other embodiments. The polishing pad 20 can lie between the workpiece 64 and the platen 62. The polishing pad 20 can have a polishing surface 614. In one embodiment, the polishing surface 614 can include the polishing surface 212 of the layer 22 and the polishing surface 216 of the pad window 26, and lie along the polishing plane 218. The workpiece 64 can include a substrate comprising a plurality of layers that can include a partially formed electronic device. The platen 62 can include an attaching surface 68. The attaching surface 68 can lie adjacent to the attaching surface 214 of the polishing pad 20. In one embodiment, the attaching surface 68 and the attaching surface 214 can lie substantially along a same plane. In another embodiment, the attaching surface 68 can be attached to the attaching surface 214. The attaching surface 68 of the platen 62 can be designed to be rigid or flexible. The platen 62 can include a material that includes a ceramic, metal, stone, rubber, plastic, PTFE, epoxy, or any combination thereof. In a further embodiment, the polishing surface 614 of the polishing pad 20 can be substantially parallel to the same plane along the attaching surface 214.

In one embodiment, the platen 62 can also include a platen window 66. In another embodiment, the platen window 66 can have a composition that can allow a predetermined wavelength or spectrum of radiation to be transmitted through the platen window 66. The exterior surface 620 of the platen window 66 can lie along a same or different plane than the attaching surface 68. A spaced-apart region 610 can be formed between the polishing pad 20 and the platen 62. The polishing surface 614 can overlie the spaced-apart region 610. The spaced-apart region 610 can include a gas at an averaged temperature. In one embodiment, the spaced-apart region 610 can lie between the pad window 26 and the platen window 66. In another embodiment, the gas within the spaced-apart region can include air. In still another embodiment, the gas within the spaced-apart region can also include argon, nitrogen, oxygen, carbon dioxide, another gas capable of passing through the pad window material, or any combination thereof. In yet another embodiment, the spaced-apart region can be substantially dry.

The platen 62 may be mechanically driven. A fluid 612 can be applied to the polishing surface 614 of the polishing pad 20. The fluid 612 can be a solution, a mixture, a suspension, a slurry, a gel, a liquid, water, or any combination thereof and can include an acid, a base, a buffer, an abrasive, a colloid, or any combination thereof. The workpiece 64 can be placed adjacent to the polishing pad 20. The polishing pad 20 can be compressed between the workpiece 64 and the platen 62 by applying a pressure to the workpiece 64, to the platen 62, or any combination thereof. The polishing pad 20 can be moved relative to the workpiece 64, the workpiece 64 can be moved relative to the polishing pad 20, or any combination thereof.

During polishing the workpiece 64, an averaged temperature of the gas within the spaced-apart region 610 can change and affect a pressure, a volume or any combination thereof of the gas within the spaced-apart region 610. Thus the change in averaged temperature can create a pressure differential across the boundary of the spaced-apart region 610 with respect to an ambient condition. The pressure differential can act as a driving force for a gas flux across a gas-permeable portion of the polishing pad 20. In one embodiment, the gas flux can be across the pad window 26. In a particular embodiment, the spaced-apart region 610 can remain substantially dry when the fluid 612 is applied to the polishing surface 614 of the polishing pad 20. If the pressure differential is not relieved, such a pressure differential can lead to a distortion of the polishing pad 20 adjacent to the spaced-apart region 610. In one embodiment, the pad window 26 can bow, which can change a radiation-affecting property or another physical property of the polishing pad 20.

In one embodiment, a radiation source 616 can be directed such that a radiation beam can pass through the pad window 26 of the polishing pad 20. The radiation beam can include visible light, coherent radiation, infrared radiation, ultraviolet radiation, x-rays, radio waves, sonic vibration, subsonic vibration, hypersonic vibration, or any combination thereof. The radiation beam can contact the workpiece 64 and subsequently be detected by a detector 618. In the illustrated embodiment, the surface of the workpiece 64 can reflect the radiation beam such that each of the radiation source 616 and the detector 618 can lie on a same side of the platen window 66. In another embodiment, the detector 618 can be positioned differently. For example, the detector 618 can be in line with the original beam line such that the radiation beam can pass through the workpiece 64 prior to detection. In yet another embodiment, the detected wavelength or spectrum can be analyzed and used as an endpoint criterion for the process. In a more particular embodiment, another criterion, such as time, another output signal from the polishing apparatus 60 (e.g., another sensor on the polishing apparatus 60), a signal from an associated piece of equipment (e.g., a chemical delivery system or a metrology tool), or any combination thereof can also be used in addition to the analysis of the detected wavelength or spectrum as an end-point criterion for the process.

In a particular embodiment, the fluid 612 can be substantially opaque to a radiation beam of the predetermined wavelength or spectrum from the radiation source 616, such that an approximately 1 mm thick layer can reduce the intensity of the radiation beam below the detection limit of the detector 618. In a more particular embodiment, pooling of the fluid 612 between the polishing surface 216 and the workpiece 64 can substantially block radiation from the radiation source 616 from reaching the detector 618.

Embodiments described herein can allow for better control over a polishing process and particularly for the use of end-point detection. A polishing pad including a gas-permeable material can improve the polishing process. A change in an averaged temperature of a gas in a spaced-apart region between the polishing pad and a platen can cause a flux of gas across the polishing pad rather than a significant distortion of the polishing pad. The polishing pad can include a pad window including a gas permeable material or composition. Such a pad window can have less distortion than a conventional polishing pad during a polishing process. Problems with endpoint detection, the pad window becoming separated from the remainder of the polishing pad, excessive wear of the pad window, a breach of the pad window, or any combination thereof may be substantially reduced or eliminated. A less distorted polishing surface can also be less likely to damage to the workpiece or the polishing apparatus during the process of polishing. Thus, a polishing apparatus and an associated process of polishing can have fewer problems.

Many different aspects and embodiments are possible. Some of those aspects and embodiments are described below. After reading this specification, skilled artisans will appreciate that those aspects and embodiments are only illustrative and do not limit the scope of the present invention.

In a first aspect, a polishing pad can include a first layer. The first layer can include a first polishing surface, a first opposing surface opposite the first polishing surface, and a first opening extending through the first layer. The polishing pad can also include a second layer comprising. The second layer can include an attaching surface. The second layer can also include a second opposing surface opposite the attaching surface, and lying closer to the first opposing surface of the first layer than to the first polishing surface of the first layer. The second layer can further include a second opening extending through the second layer, the second opening substantially contiguous with the first opening of the first layer. The polishing pad can also include a pad window lying within the first opening. The pad window can include a second polishing surface substantially contiguous with the first polishing surface. The pad window can also include a third opposing surface opposite the second polishing surface, wherein the third opposing surface lies in a region between the first polishing surface of the first layer and the attaching surface of the second layer. The pad window can further include a gas-permeable material.

In one embodiment of the first aspect, the pad window can include a composition that is capable of allowing transmission of a predetermined wavelength or spectrum of radiation. In another embodiment, the first layer and the pad window each comprise a urethane, a polyethylene, a polytetrafluoroethylene, a polypropylene, or any combination thereof. In still another embodiment, the first opposing surface of the first layer lies adjacent to the second opposing surface of the second layer.

In another embodiment of the first aspect, a first perimeter of the first opening has a different length than a second perimeter of the second opening. In still another embodiment, the first polishing surface of the first layer and the second polishing surface of the pad window lie substantially along a polishing plane. A first elevation from the third opposing surface of the pad window to the polishing plane is less than a second elevation from the attaching surface to the polishing plane. In yet another embodiment, the first elevation is less than a third elevation from the first opposing surface of the first layer to the polishing plane.

In a second aspect, a polishing apparatus can include a platen including a first attachings surface. The polishing apparatus can also include a polishing pad including a first layer overlying and spaced-apart from the platen. The first layer can include a first polishing surface, a first opposing surface opposite the first polishing surface, and a first opening extending through the first layer. The polishing pad can also include a second layer lying between the first layer and the platen. The second layer can include a second attaching surface lying adjacent to the first attaching surface of the platen. The second layer can also include a second opposing surface opposite the second attaching surface, and lying closer to the first opposing surface of the first layer than to the first polishing surface of the first layer. The second layer can further include a second opening extending through the second layer, the second opening substantially contiguous with the first opening of the first layer. The polishing pad can also include a pad window lying within the first opening of the first layer. The pad window can include a second polishing surface substantially contiguous with the first polishing surface of the first layer. The pad window can also include a third opposing surface opposite the second polishing surface. The pad window can comprise a gas-permeable material.

In one embodiment of the second aspect, the platen can further include a platen window, and the pad window can overlie the platen window. The apparatus can also include a radiation source configured to direct a predetermined wavelength or spectrum of radiation through the second polishing surface of the pad window. In another embodiment, each of the platen window and the pad window can be capable of allowing transmission of the predetermined wavelength or spectrum of radiation. In yet another embodiment, a spaced-apart region can lie between the third opposing surface of the pad window and the platen.

In a particular embodiment of the second aspect, the spaced-apart region can include air, argon, nitrogen, oxygen, carbon dioxide, or any combination thereof. In another embodiment, the first opposing surface of the first layer can lie immediately adjacent to the second opposing surface of the second layer. In still another embodiment, the first polishing surface of the first layer and the second polishing surface of the pad window can lie along a same plane. In a more particular embodiment, the third opposing surface can lie farther from the same plane than from a plane along the second attaching surface of the second layer. In yet another embodiment, the composition of the pad window can include a urethane, a polyethylene, a polytetrafluoroethylene, a polypropylene, or any combination thereof.

In a third aspect, a process of polishing can include forming a spaced-apart region between a polishing pad and a platen. The spaced-apart region can include a gas, and the gas can have a first averaged temperature. The process can also include polishing a workpiece, wherein at a point in time during polishing, the spaced-apart region lies between the platen and the workpiece. The process can also include changing a temperature of the gas within the spaced-apart region from the first averaged temperature to a second averaged temperature after polishing the workpiece has started. The process can further include forming a gas flux across the polishing pad after polishing the workpiece has started.

In one embodiment of the third aspect, the process can further include applying a fluid to a polishing surface of the polishing pad. The polishing surface can overlie the spaced-apart region and the spaced-apart region can remain substantially dry. In another embodiment, the platen can further include a platen window, and the pad can further include a pad window. Further, the spaced-apart region can lie between the platen window and the pad window. In a more particular embodiment, the process can further include directing a radiation beam at the workpiece such that the radiation beam passes through a polishing surface of the polishing pad. The process can also include detecting a predetermined wavelength or spectrum of radiation from the radiation beam. The process can still further include analyzing the radiation beam after detecting the predetermined wavelength or spectrum of radiation. The process can also include whether an endpoint has been reached.

Note that not all of the activities described above in the general description or the examples are required, that a portion of a specific activity may not be required, and that one or more further activities may be performed in addition to those described. Still further, the order in which activities are listed are not necessarily the order in which they are performed. After reading this specification, skilled artisans will be capable of determining which one or more activities or one or more portions thereof are used or not used and the order of such activities are to be performed for their specific needs or desires.

Any one or more benefits, one or more other advantages, one or more solutions to one or more problems, or any combination thereof have been described above with regard to one or more specific embodiments. However, the benefit(s), advantage(s), solution(s) to problem(s), or any element(s) that may cause any benefit, advantage, or solution to occur or become more pronounced is not to be construed as a critical, required, or essential feature or element of any or all the claims.

The above-disclosed subject matter is to be considered illustrative, and not restrictive, and the appended claims are intended to cover all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A polishing pad comprising:

a first layer comprising:

a first polishing surface;

a first opposing surface opposite the first polishing surface; and a first opening extending through the first layer;

a second layer comprising:

an attaching surface;

a second opposing surface opposite the attaching surface, and lying closer to the first opposing surface of the first layer than to the first polishing surface of the first layer; and a second opening extending through the second layer, the second opening substantially contiguous with the first opening of the first layer; and a pad window lying within the first opening and comprising:

a second polishing surface substantially contiguous with the first polishing surface; and a third opposing surface opposite the second polishing surface, wherein the third opposing surface lies in a region between the first polishing surface of the first layer and the attaching surface of the second layer, and the pad window comprises a gas-permeable material.

2. The polishing pad of claim 1, wherein the pad window comprises a composition that is capable of allowing transmission of a predetermined wavelength or spectrum of radiation.

3. The polishing pad of claim 1, wherein the first layer and the pad window each comprise a urethane a polyethylene, a polytetrafluoroethylene, a polypropylene, or any combination thereof.

4. The polishing pad of claim 1, wherein the first opposing surface of the first layer lies adjacent to the second opposing surface of the second layer.

5. The polishing pad of claim 1, wherein a first perimeter of the first opening has a different length than a second perimeter of the second opening.

6. The polishing pad of claim 1, wherein:

the first polishing surface of the first layer and the second polishing surface of the pad window lie substantially along a polishing plane; and a first elevation from the third opposing surface of the pad window to the polishing plane is less than a second elevation from the attaching surface to the polishing plane.

7. The polishing pad of claim 6, wherein the first elevation is less than a third elevation from the first opposing surface of the first layer to the polishing plane.

8. A polishing apparatus comprising:

a platen comprising a first attaching surface; and a polishing pad comprising:

a first layer overlying and spaced-apart from the platen, wherein the first layer comprises:

a first polishing surface;

a first opposing surface opposite the first polishing surface; and a first opening extending through the first layer;

a second layer lying between the first layer and the platen, wherein the second layer comprises:

a second attaching surface lying adjacent to the first attaching surface of the platen;

a second opposing surface opposite the second attaching surface, and lying closer to the first opposing surface of the first layer than to the first polishing surface of the first layer; and a second opening extending through the second layer, the second opening substantially contiguous with the first opening of the first layer; and a pad window lying within the first opening of the first layer and comprising:

a second polishing surface substantially contiguous with the first polishing surface of the first layer; and a third opposing surface opposite the second polishing surface, and the pad window comprises a gas-permeable material.

9. The polishing apparatus of claim 8, wherein:

the platen further comprises a platen window;

the pad window overlies the platen window; and the apparatus further comprises a radiation source configured to direct a predetermined wavelength or spectrum of radiation through the second polishing surface of the pad window.

10. The polishing apparatus of claim 9, wherein each of the platen window and the pad window is capable of allowing transmission of the predetermined wavelength or spectrum of radiation.

11. The polishing apparatus of claim 8, wherein a spaced-apart region lies between the third opposing surface of the pad window and the platen.

12. The polishing apparatus of claim 11, wherein the spaced-apart region comprises air, argon, nitrogen, oxygen, carbon dioxide, or any combination thereof.

13. The polishing apparatus of claim 8, wherein the first opposing surface of the first layer lies immediately adjacent to the second opposing surface of the second layer.

14. The polishing apparatus of claim 8, wherein the first polishing surface of the first layer and the second polishing surface of the pad window lie along a same plane.

15. The polishing apparatus of claim 14, wherein the third opposing surface lies farther from the same plane than from a plane along the second attaching surface of the second layer.

16. The polishing apparatus of claim 8, wherein a composition of the pad window comprises a urethane, a polyethylene, a polytetrafluoroethylene, a polypropylene, or any combination thereof.

17. A process of polishing comprising:

forming a spaced-apart region between a polishing pad and a platen, wherein the spaced-apart region comprises a gas, and the gas has a first averaged temperature;

polishing a workpiece, wherein at a point in time during polishing, the spaced-apart region lies between the platen and the workpiece;

changing a temperature of the gas within the spaced-apart region from the first averaged temperature to a second averaged temperature after polishing the workpiece has started; and forming a gas flux across the polishing pad after polishing the workpiece has started.

18. The process of claim 17, further comprising applying a fluid to a polishing surface of the polishing pad wherein the polishing surface overlies the spaced-apart region and the spaced-apart region remains substantially dry.

19. The process of claim 17, wherein:

the platen further comprises a platen window; and the pad further comprises a pad window; and the spaced-apart region lies between the platen window and the pad window.

20. The process of claim 19, further comprising:

directing a radiation beam at the workpiece such that the radiation beam passes through a polishing surface of the polishing pad;

detecting a predetermined wavelength or spectrum of radiation from the radiation beam;

analyzing the radiation beam after detecting the predetermined wavelength or spectrum of radiation; and determining whether an endpoint has been reached.

* * * * *